US006289635B1

(12) United States Patent
Procton et al.

(10) Patent No.: US 6,289,635 B1
(45) Date of Patent: Sep. 18, 2001

(54) CONTINUOUS HANDICAP THRESHOLD ASSEMBLY WITH DUAL DAMS AND SELECTIVELY POSITIONABLE SIDELIGHT CAP

(75) Inventors: Brad I. Procton, High Point; Victor T. Massey, Greensboro, both of NC (US); John E. Staskiewicz, Atlanta, GA (US)

(73) Assignee: Endura Products, Inc., Colfax, NC (US)

( * ) Notice: Subject to any disclaimer, the term of this patent is extended or adjusted under 35 U.S.C. 154(b) by 0 days.

(21) Appl. No.: 09/401,086

(22) Filed: Sep. 22, 1999

(51) Int. Cl.[7] ..... E06B 1/70
(52) U.S. Cl. ..... 49/467
(58) Field of Search ..... 49/467, 469, 471; 52/211, 209, 302.1

(56) References Cited

U.S. PATENT DOCUMENTS 4,104,830 * 8/1978 Eagle ..... 49/469 X
5,010,690 * 4/1991 Geoffrey ..... 49/469 X
5,517,788 * 5/1996 McGough et al. ..... 49/467 X
5,673,517 * 10/1997 Stanclift ..... 49/467
5,687,508 * 11/1997 Fitzhenry et al. ..... 49/471
5,706,607 * 1/1998 Frey ..... 49/469 X

* cited by examiner

*Primary Examiner*—Jerry Redman
(74) *Attorney, Agent, or Firm*—Womble Carlyle Sandridge & Rice, PLLC

(57) ABSTRACT

A continuous handicap threshold assembly for an entryway has an elongated extruded aluminum body with a threshold portion for extending continuously beneath a closed door and at least one fixed panel such as a sidelight or patio door. An exterior sill extends outwardly and slopes downwardly from said threshold portion and an interior sill extends inwardly from said threshold portion. The threshold portion projects a small distance upwardly from the sills to define exterior and interior dams to prevent water leakage. To accommodate the fixed panel, a plastic sidelight cap is adapted to be selectively positioned along the length of the body covering a section of the threshold portion to underlie and support the fixed panel of the entryway.

16 Claims, 4 Drawing Sheets

CONTINUOUS HANDICAP THRESHOLD ASSEMBLY WITH DUAL DAMS AND SELECTIVELY POSITIONABLE SIDELIGHT CAP

TECHNICAL FIELD

This invention relates generally to threshold assemblies for installation in entryways of buildings and more specifically to handicap threshold assemblies configured to be easily traversable by a wheelchair.

BACKGROUND

A threshold assembly is that portion of an entryway system that underlies the door and, in many instances, one or more sidelights or side panels that flank the door. Threshold assemblies have evolved significantly over the past few decades from wooden thresholds, to thresholds formed of simple static aluminum extrusions, to complex modern threshold assemblies, which usually incorporate extruded aluminum portions with adjustable threshold caps and sophisticated water shedding and sealing mechanisms. In the case of entryways with sidelights, modern threshold assemblies are designed to be continuous; that is, to extend continuously without breaks beneath the door, sidelights, and mull posts that separate them. Such continuous sidelight sills reduce significantly the leakage problems common in older "box" construction sidelight entryways, wherein separate threshold sections underlie the door and sidelights. The same is true of patio door entryways, wherein a pair of doors are mounted in an entryway with one door being fixed and the other being hinged for opening and closing. Thus, whenever the terms sidelight entryway, sidelight sill, sidelight cap, and terms of similar import are used herein, it will be understood that the discussion also is equally applicable to patio door entryways and, in fact, to any door unit having a fixed panel and a hinged door.

While modern threshold assemblies function substantially better than their older counterparts, they nevertheless have not generally been designed with the handicapped or otherwise wheelchair bound person in mind. For example, their height and profile oftentimes present difficult or impossible barriers to a handicapped person wishing to enter a building in a wheelchair. In many instances, the thresholds can only be traversed with the help of another, which is inconvenient and can even be embarrassing or degrading to the handicapped individual.

While threshold assemblies adapted to be traversed by a wheelchair have been developed, and standards to handicap thresholds are set forth in the Americans with Disabilities Act (ADA) the evolution of handicap thresholds has generally not kept pace with that of standard threshold assemblies. For example, many handicap threshold assemblies fail to incorporate the water sealing technologies of standard assemblies and are thus susceptible to leaks between the threshold and a closed door, particularly during driving or wind blown rains. Further, currently available handicap thresholds are not designed to accommodate entryways with sidelight panels, which nevertheless are popular and common architectural features. In cases where a handicapped accessible entryway includes sidelights, door manufacturers have been left with the old box method of accommodating the sidelights, which, as mentioned above, leads to leaks and also to increased manufacturing complexity.

Thus, a need exists for a handicap threshold assembly that incorporates the leak resistance of modern standard threshold assemblies, that easily accommodates entryways with sidelight panels, and that also meets ADA standards for easy traversal by an individual in a wheelchair. It is to the provision of such a threshold assembly that the present invention is primarily directed.

SUMMARY OF THE INVENTION

Briefly described, the present invention, in one preferred embodiment thereof, comprises a continuous handicap threshold assembly for installation beneath the door and sidelights of an entryway system. The threshold assembly comprises an elongated preferably extruded aluminum body having a threshold portion for underlying a closed door, an exterior sill that extends outwardly and slopes downwardly from the threshold portion, and an interior sill that projects in the opposite direction from the threshold portion. The body is profiled to extend a maximum of one-half inch above the floor in order to meet ADA standards and to be easily traversable by an individual in a wheelchair.

The threshold portion of the assembly projects upwardly a relatively small distance from the exterior and interior sills to define dams that extend along the junction of the sills and the threshold portion. These dams form barriers that prevent the leakage of rainwater across the threshold portion and into a building. Exterior and interior lips project a short distance horizontally from the tops of the dams so that each dam and its lip define a detent or groove that extends along the length of the threshold body.

The threshold assembly of this invention is particularly suited for use with an entryway having an openable door flanked by a fixed panel such as one or two sidelights. When used with such an entryway, the body of the assembly extends continuously beneath both the door and the sidelight panels. Sidelight caps, preferably formed of extruded plastic material, are configured to fit atop the threshold body in the regions that underlie each of the sidelight panels. Each sidelight cap is configured to snap into place on the body overlying the threshold portion thereof and to receive, support, and seal against a sidelight panel resting on the cap. In this regard, each sidelight cap is formed with an elongated horizontal upper surface supported along each edge by a pair of depending legs. The cap has a width greater than the width of the threshold portion of the body and is configured to cover the threshold portion in a region that underlies a sidelight panel. A pair of tabs project inwardly from the bottoms of each depending leg and the tabs are sized and configured to be received in respective ones of the grooves formed by the dams and lips. Thus, each threshold cap can be snapped into place on the body covering the threshold portion in the region of a sidelight panel. Further, the sidelight caps can be cut to length easily and selectively positioned at any desired location along the threshold body. The threshold assembly is therefore fully adaptable to any fixed panel/openable door entryway, whether it be a double sidelight entryway, a left hand sidelight entryway, a right hand sidelight entryway, or a patio door entryway.

Accordingly, a continuous handicap threshold assembly is now provided that successfully addresses the problems and shortcomings of the prior art. The assembly meets ADA standards; incorporates dual dams to prevent migration of rainwater; extends continuously beneath both the door and its sidelights, thereby eliminating the need for the box construction used in the past; and includes selectively positionable sidelight caps to accommodate virtually any sidelight or patio door entryway configuration. These and other features and advantages will become more apparent upon review of the detailed description set forth below, when taken in conjunction with the accompanying drawing figures, which are briefly described as follows.

DETAILED DESCRIPTION

Figure 1:
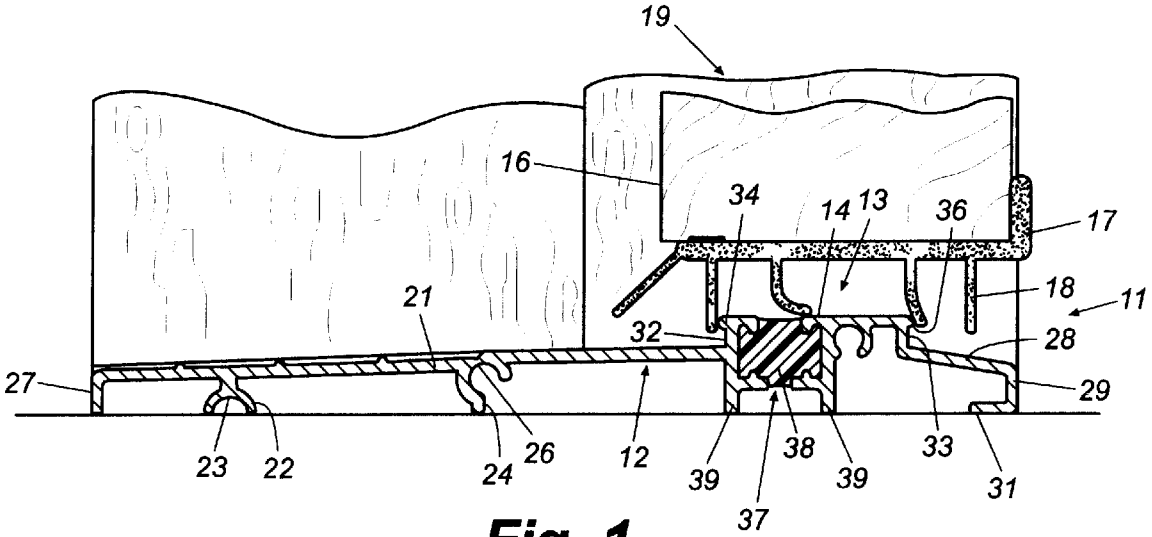
FIG. 1 is a cross-sectional view of a handicap threshold assembly that embodies principles of the invention and that is designed for use with an inswing entryway.

Referring now in more detail to the drawings, in which like numerals refer to like parts throughout the several views, FIG. 1 is a cross-sectional view of a threshold assembly that embodies principles of the invention and that is configured for use with an inswing door. The threshold assembly 11 comprises an elongated body 12, which preferably is formed of extruded aluminum but that also may be formed of an alternate material such as plastic or composites. The body 12 is profiled to define a threshold portion 13 having an upper surface 14 positioned to underlie a closed door 16 mounted within a door frame 19. In the illustrated embodiment, the door 16 is provided with a flexible sweep 17 extending along the bottom edge of the door. Conventionally, the sweep 17 has depending flexible fins 18, some of which engage and seal against the threshold portion 13 and some of which are positioned and oriented to shed water away from the bottom of the door. The particular configuration of the door and sweep shown in FIG. 1, and, for that matter, in some of the other figures, is exemplary only and is shown to illustrate the invention better. Many types of doors and sweeps are available and may be used with the threshold assembly of this invention.

The threshold assembly is further profiled to define an exterior sill 21 that projects outwardly and slopes downwardly from the threshold portion 13 of the assembly. The sill 21 is supported by a forward sill support 22, which also forms a caulking groove 23, and a rear sill support 24, which also forms a screw boss 26 for attaching the threshold assembly to the bottoms of the vertical jambs of a door frame with the threshold assembly extending between the jambs. The sill 21 extends from the threshold portion to an exterior edge 27, which is down-turned to engage a support surface. A relatively short interior sill 28 extends from the other side of the threshold portion 13 to a down-turned interior edge 29, which preferably is formed with an in-turned foot 31, which rests upon a support surface to support the interior sill 28.

The threshold portion 13 of the assembly projects slightly upwardly from the exterior sill 21 to form an exterior dam 32 that extends along the length of the body 12 at the junction of the threshold portion and the exterior sill. Similarly, the threshold portion also projects slightly upwardly from the interior sill 28 to form an interior dam 33. The dual dams 32 and 33 form barriers against the migration of water from the sills across the threshold portion of the assembly. This is particularly important in the case of the exterior dam 32 because in many installations the exterior sill 21 is exposed to rain and also receives runoff rain from the exterior surface of the door 16. Even though the exterior sill 21 is sloped downwardly, its slope is slighter than that of a conventional threshold assembly in order to provide easy traversal by a wheelchair. Accordingly, even a slightly windblown rain can cause water to be blown up the sill toward the threshold portion of the assembly. The exterior dam 32 encounters and stops the water.

An exterior overhang or lip 34 projects outwardly from the top of the exterior dam 32 and the lip 34 and dam 32 together form an exterior groove that extends along the length of the threshold assembly. Similarly, an interior lip 36 projects from top of the interior dam 33 and, together with the dam 33, forms an interior groove that also extends along the length of the threshold assembly. The exterior and interior grooves enhance the function of the dams 32 and 33 in preventing water seepage under a closed door. The grooves also provide means for mounting one or more sidelight caps or a fixed patio door to the threshold assembly, as described in more detail below.

Conventionally, a thermal break 37 is provided along the length of the threshold assembly 11 in the region of the threshold portion 13. The thermal break 37 is formed by a thermally insulating material 38 that joins interior and exterior portions of the threshold assembly to form a monolithic structure. Where the sill is formed of extruded aluminum, the thermal break 37 prevents condensation on interior portions of the assembly in cold weather by thermally insulating the interior portion from the exposed exterior portion. Support legs 39 project downwardly on either side of the thermal break 37 to provide support for the threshold portion 13 of the assembly and to prevent undue mechanical stress on the thermal break during use of the threshold assembly.

Figure 2:
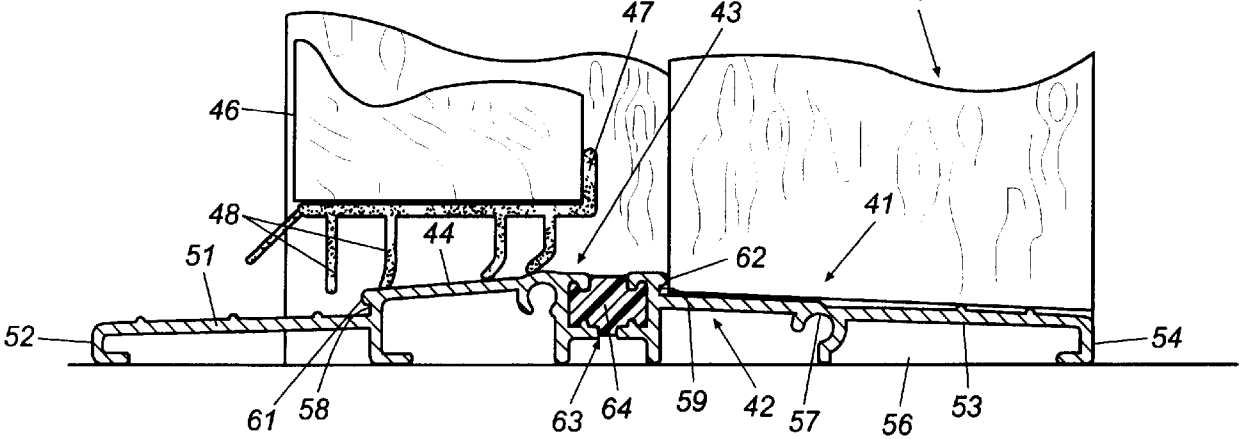
FIG. 2 is a cross sectional view of a handicap threshold assembly embodying principles of the invention and designed for use with an outswing entryway.

FIG. 2 illustrates similar principles of the invention in the form of a handicap threshold assembly for use with an outswing door. Here, the handicap threshold assembly 41 has an elongated preferably extruded aluminum body 42 with an upwardly projecting generally centrally located threshold portion 43 having an upper surface 44 positioned to underlie a closed door 46 mounted within a door frame 49. As with the prior embodiment, a sweep 47 having depending flexible fins 48 is mounted to and extends along the bottom edge of the door 46 for sealing against and shedding water away from the threshold portion 43.

An exterior sill 51 extends outwardly and slopes slightly downwardly from the threshold portion 43 to an exterior edge 52. An interior sill 53 extends from the other side of the threshold portion 43 and slopes downwardly to a down turned interior edge 54. The interior sill is supported on a support 56, which is also formed to define a screw boss 57. A thermal break 63 formed of thermally insulating material 64 bridges a gap between the interior and exterior portions of the body 42 to prevent condensation on interior portions of the assembly during cold weather. The upper surface 44 of the threshold portion preferably slopes slightly downwardly toward the exterior sill 51 to help shed any water that may collect on the threshold portion.

The threshold portion 43 projects upwardly from the exterior and interior sills 51 and 53 respectively to form an exterior dam 58 and an interior dam 59, similar to the dams of the embodiment of FIG. 1. An exterior lip 61 projects from the top of the exterior dam 58 to define with the dam a longitudinally extending groove along the junction between the exterior sill 51 and the threshold portion 43. Similarly, an interior lip 62 projects from the top of the interior dam 59 to form a longitudinally extending groove along the junction of the interior sill 53 and the threshold portion 43. These grooves are sized to receive one or more sidelight caps mounted to the threshold assembly in sidelight door installations, as detailed below.

The inswing threshold assembly 11 of FIG. 1 and the outswing threshold assembly 41 of FIG. 2 are each configured to meet ADA standards as handicap thresholds. In this regard, each of the threshold assemblies projects upwardly from its support surface no more that one-half inch. Further the slope of the exterior and interior sills is slight, which allows an individual in a wheelchair to traverse the threshold assemblies with ease and without the help of another. As mentioned above, the dual dams of the threshold assemblies help compensate for the slight slopes of the sills, which otherwise can lead to water leakage, particularly during wind-blown rains. The dams of the present invention provide a positive barrier to windblown rain and prevent leakage from either of the sills past the threshold portions of the assemblies.

The handicap threshold assemblies of the present invention are particularly suited and configured for use with entryways having an openable door with one or more flanking fixed panels such as a patio door or a sidelight panel. In such installations, the threshold assemblies extend continuously beneath both the door of the entryway and the fixed panels. A continuous sill in these situations greatly reduces leakage common in old box style sidelight construction, and also simplifies the manufacturing process. FIGS. 3 through 6 illustrate, in various embodiments, the threshold assembly of this invention with sidelight caps for use with sidelight entryway systems. These illustrated embodiments also apply to patio door entryways.

Figure 3:
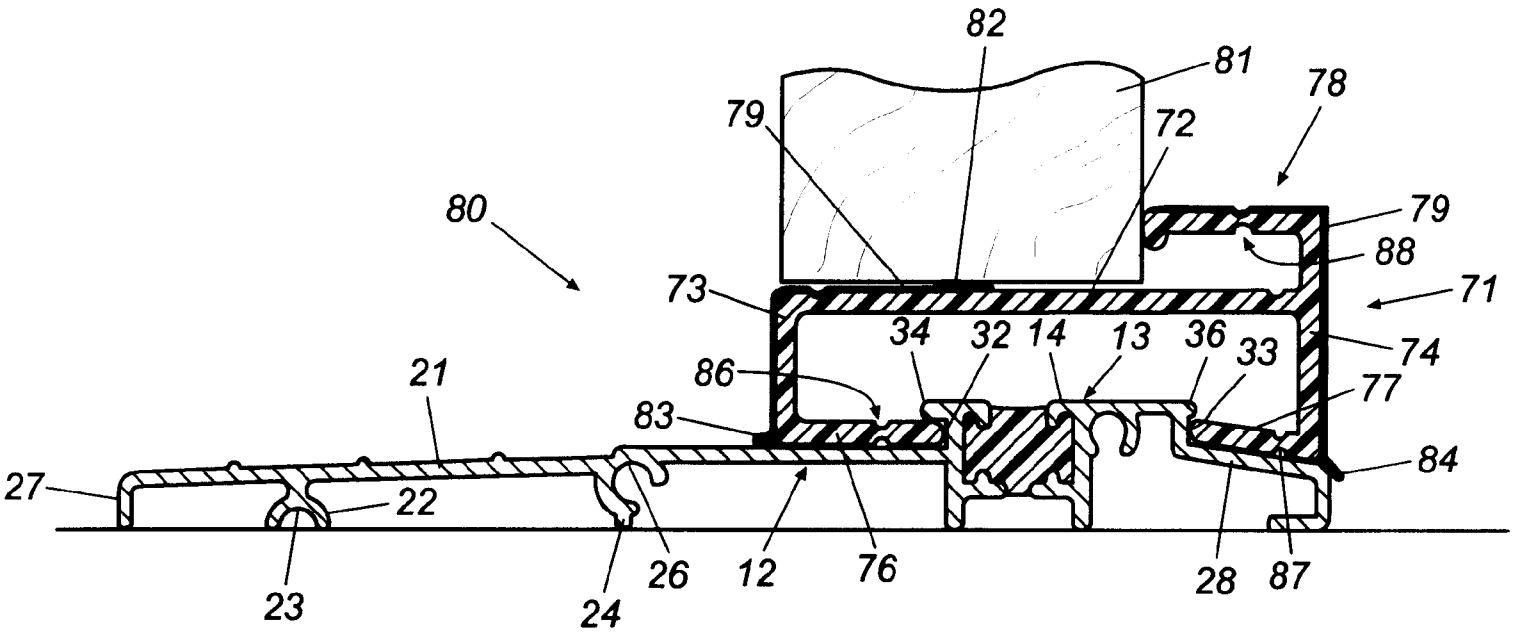
FIG. 3 is a cross-sectional view of the inswing threshold assembly of FIG. 1 illustrating use of the selectively positionable sidelight cap to support a sidelight panel.

In FIG. 3, an inswing threshold assembly 80 is illustrated with the included sidelight cap 71 supporting a sidelight panel 81. The threshold assembly 80 includes the extruded aluminum body 12 of FIG. 1, which includes a threshold portion 13 with an upper surface 14, an exterior sill 21, and an interior sill 28. Dams 32 and 33 with their projecting lips 34 and 36 from exterior and interior grooves extending along the junctions of the exterior and interior sills respectively with the threshold portion of the assembly.

A sidelight cap 71 is mounted atop the body 12 of the assembly for receiving and supporting a sidelight panel 81, which generally is located on one side of the door of an entryway. The sidelight cap 71, preferably formed of extruded or co-extruded plastic, has a generally horizontal support surface 72 supported above the threshold portion 13 on a vertically extending exterior leg 73 and a vertically extending interior leg 74. An exterior tab 76 projects inwardly from the bottom of the exterior leg 73 and an interior tab 77 projects inwardly from the bottom of the interior leg 74. The exterior tab 76 rests on the external sill 21 and is sized to extend into the groove formed by the dam 32 and lip 34 at the junction of the exterior sill and threshold portion. Similarly, the interior tab 77 rests on the interior sill 28 and extends into the groove formed by the dam 33 and tab 36 along the junction between the interior sill 28 and the threshold portion. A raised stop 78 is formed along the interior side of the support surface 72 for abutting and positioning the sidelight panel 81. The raised stop 78 also forms a barrier against migration of water under the sidelight panel and into a building. Score lines 86, 87, and 88 are formed along the exterior tab 76, the interior tab 77, and the raised stop 78 respectively for purposes described in more detail below.

The sidelight cap 71 preferably is co-extruded with a relatively rigid high durometer plastic body for supporting the weight of a sidelight panel and a relatively softer low durometer plastic skin 79 at selected critical locations on the cap. The sidelight cap is further formed with flexible fins at key locations on the cap for providing seals against the migration of water. Specifically, a flexible fin 83 is formed along the bottom of the exterior leg 73 for sealing against the exterior sill 21 of the assembly, a flexible fin 84 is formed along the bottom of the interior leg 74 for sealing against the interior edge of the assembly, and a flexible fin 82 is formed along the support surface 72 of the cap for sealing against the bottom of a sidelight panel 81 supported atop the sidelight cap. Seals may also be provided at other locations if desired according to needs of a particular application.

With the just described configuration, it will be seen that the sidelight cap of the assembly "snaps" into place on the body with its exterior and interior tabs 76 and 77 extending into the exterior and interior grooves of the threshold body. Further, and of key significance, the sidelight cap 71 can be mounted on the body 12 at any desired location therealong or can be snapped into place and slid longitudinally to a desired location. The sidelight cap is therefore selectively positionable and infinitely adjustable along the length of the threshold body. In this way, a standard threshold assembly of this invention can be adapted for use with a right or left sidelight entryway, a double sidelight entryway, or any size and configuration of patio door entryway as required. In addition, since the sidelight cap is made of extruded plastic, it can easily be cut by a contractor or entryway manufacturer to any length required to accommodate the width of a sidelight panel. Finally, the fact that the threshold cap rests atop the body of the threshold assembly covering the threshold portion thereof allows the threshold assembly of this invention to be continuous; that is, to extend continuously beneath the door and sidelight panels of an entryway system. As mentioned above this feature greatly reduces manufacturing time and cost and substantially reduces leakage common with prior art box construction techniques.

Figure 4:
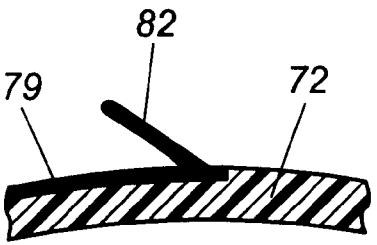
FIG. 4 is an enlarged cross-sectional view of a coextruded flexible fin on the support surface of the sidelight cap for sealing against the bottom of a sidelight panel.

FIG. 4 is an enlarged cross-section of a portion of the support surface 72 of the sidelight cap 71. The body of the support surface 72 is formed of extruded plastic material and a co-extruded skin 79 is formed on the outer surface of at least a portion of the support surface. Since the skin 79 is co-extruded with the body of the support surface, it is bonded thereto and forms a monolithic part of the body. Preferably, the skin is made of a lower durometer plastic material than the body and includes an upstanding flexible fin 82 for sealing against the bottom of a sidelight panel resting on the sidelight cap 71. As discussed above relative to FIG. 3, such a skin and integral sealing fins are provided elsewhere on the cap as well and may be provided anywhere on the cap where a seal is needed. Thus, the particular configuration and placement of the lower durometer skin and sealing fins illustrated in the figures should be considered exemplary only and are presented to represent the best mode known to the inventors of carrying out the invention. Many other configurations are possible, including no skin or fins, and all such configurations should be considered to be within the scope of the invention.

Figure 5:
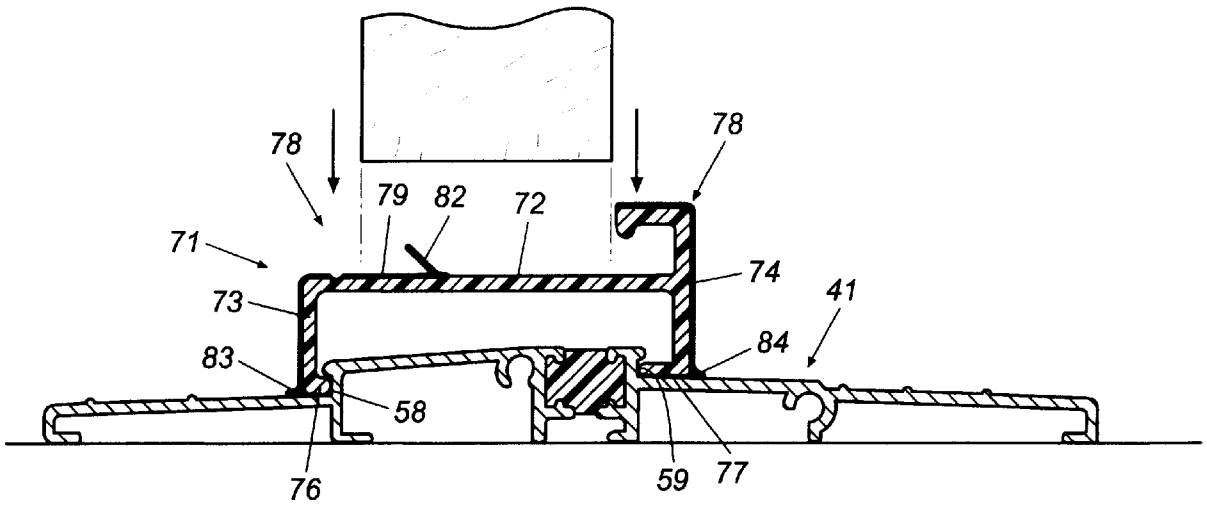
FIG. 5 is a cross-sectional view of the outswing threshold assembly of FIG. 2 illustrating use of the selectively positionable sidelight cap to support a sidelight panel.

FIG. 5 illustrates the sidelight cap of the invention as a part of an outswing handicap threshold assembly 41 (FIG. 2). Here, the sidelight cap 71, which is the same standard sidelight cap shown in FIG. 4, is shown mounted to the body of the threshold assembly covering the threshold portion thereof. However, for this installation, the sidelight cap has been adapted by breaking off a portion of the inwardly extending tabs 76 and 77 and a portion of the stop 78 along their respective score lines 86, 87, and 88 (FIG. 3). With this modification made to the threshold cap 71, the now shorter tabs 77 and 78 extend into the longitudinal grooves formed by dams 58 and 59 to snap and hold the threshold securely to the body of the assembly. As with the embodiment of FIG. 3, the sidelight cap may be cut to any desired length and selectively positioned along the length of the body of the threshold assembly to accommodate left, right, or double sidelight entryway systems and patio doors. Flexible fins 92, 83, and 84 form seals between the sidelight cap 71 and a sidelight panel, the exterior sill, and the interior sill respectively. It will thus be seen that the present invention includes a standard sidelight cap that is adaptable for use with both inswing and outswing handicap threshold assemblies.

Figure 6:
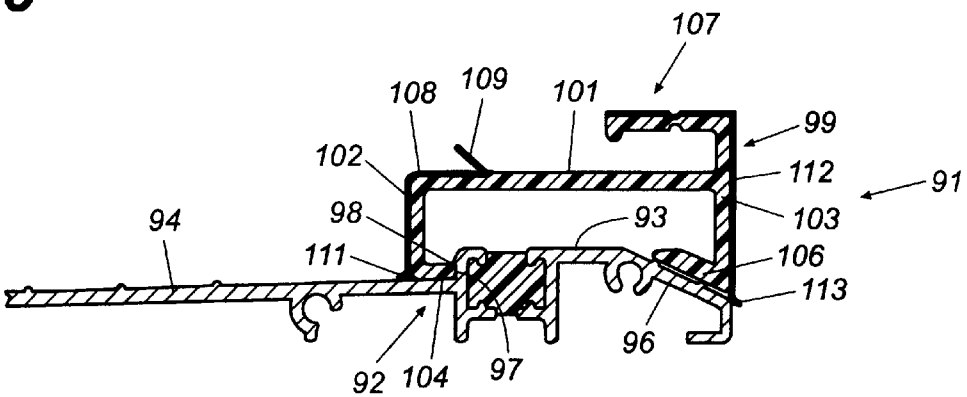
FIG. 6 is a cross-sectional view of an alternate embodiment of a handicap threshold assembly and sidelight cap.

FIG. 6 illustrates an alternate embodiment of the threshold assembly of this invention wherein the sidelight cap is mounted to a handicap sill of a slightly different configuration. Here, the threshold assembly 91 includes an elongated preferably extruded aluminum body 92 having a threshold portion 93 for underlying a closed door and an exterior sill 94 that extends outwardly and slopes downwardly from the threshold portion. An interior sill 96 slopes inwardly and downwardly from the threshold portion but, unlike prior embodiments, is substantially continuous With the upper surface of the threshold portion. A dam 97 and lip 98 are formed along the junction of the exterior sill and the threshold portion of the assembly and, together, they define a longitudinal groove extending along the junction.

The sidelight cap 99 has an upper support surface 101 that is positioned to overly the threshold portion 93 by an exterior leg 102 and an interior leg 103. An inwardly extending tab 104 extends into the longitudinal groove formed by the dam 97 and lip 98 and an inwardly extending tab 106 rests atop the interior sill 96. The sidelight cap is thus selectively positionable along the length of the body to accommodate various sidelight or patio door entryway systems. As with prior embodiments, the sidelight cap 99 is made of co-extruded plastic material and preferably has a lower durometer skin 108 and 112 on selected portions of the cap and also includes flexible sealing fins 109, 111, and 113 for sealing against a sidelight cap, the exterior sill, and the interior sill of the assembly. In fact, the sidelight cap of this embodiment can be the same standard sidelight cap illustrated with prior embodiments adapted for use with a threshold body profile slightly different from the profiles of FIGS. 1 and 2.

Figure 7:
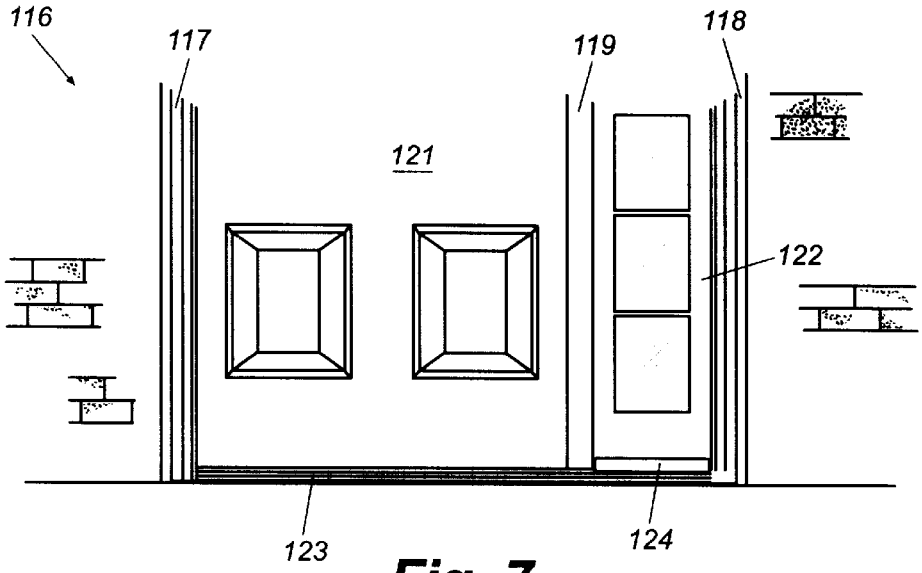
FIG. 7 is a front plan view of a single sidelight entryway that incorporates the threshold assembly of this invention.

FIG. 7 illustrates a typical right hand sidelight entryway system incorporating the handicap threshold assembly of this invention. The entryway 116 includes vertical door jambs 117 and 118, which frame the entryway on either side, and an intermediately positioned vertical mullion or mull post 119, which partitions the entryway into a door frame on the left and a sidelight frame on the right. A door 121 is mounted in the door frame and a sidelight panel 122 is mounted in the sidelight frame. According to the invention, a continuous handicap threshold assembly extends beneath the door and the sidelight panel and includes an extruded aluminum body 123 and a sidelight cap 124 mounted atop the body and positioned to underlie and support the sidelight panel 122. It will be seen that a left hand sidelight entryway may also be accommodated simply by positioning the sidelight cap on the left side of the threshold body and a double sidelight entry may be accommodated by locating a sidelight cap on either end of the threshold body. In addition, a patio door entryway can be accommodated by positioning a sidelight cap beneath the fixed door of he entryway. The flexibility of this invention is thus apparent as is its continuous construction, which provides superior performance and reduces fabrication costs.

Figure 8:
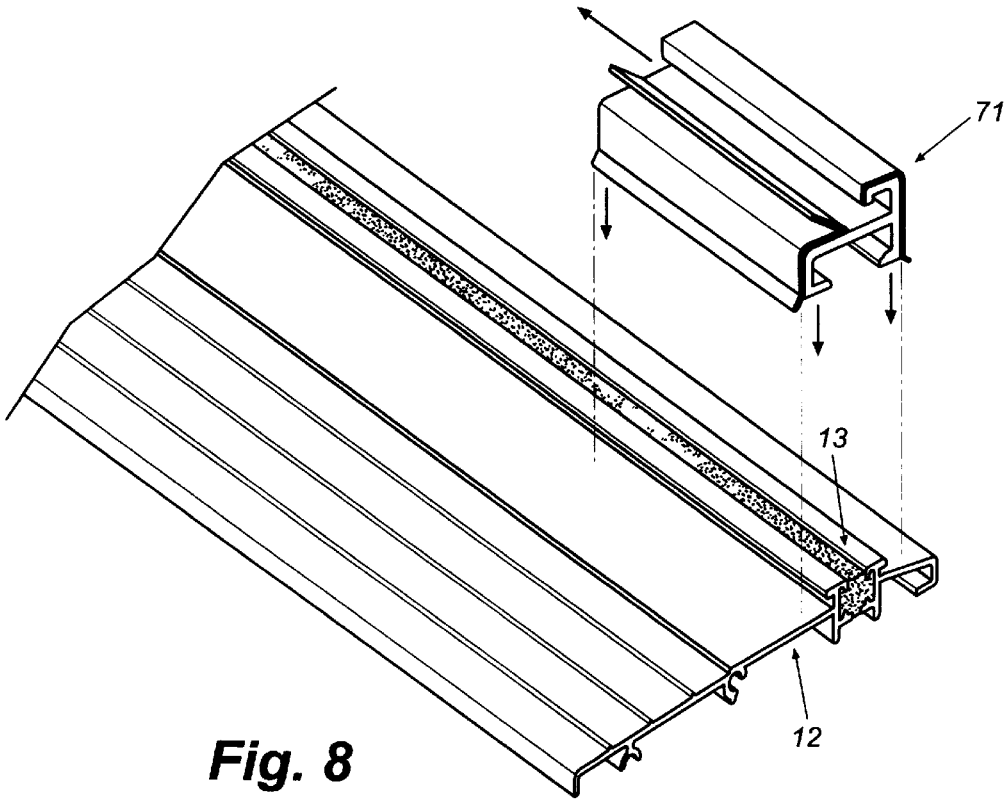
FIG. 8 is a perspective view of the threshold assembly of FIG. 3 illustrating placement of the sidelight cap on the threshold body.

Finally, FIG. 8 is a perspective view of the threshold assembly of the invention showing a portion of the threshold body 12 and the threshold cap 71 being snapped into place on the body. From this figure, the selectively positionable and infinitely adaptable nature of the sidelight cap is apparent.

The invention has been described herein in terms of preferred embodiments and methodologies. It will be apparent to those of skill in the art, however, that various modification may be made to the illustrated embodiments within the scope of the invention. For example, while it is preferred that the body of the assembly be made of extruded aluminum and the sidelight cap be made of extruded plastic, other materials such as metals other than aluminum, composites, molded rather than extruded components and other materials and fabrication techniques may also be employed. Further, the particular profiles of the illustrated embodiments, while preferred, are not intended to be limiting and other profiles might well be designed depending on the particular intended use of the assembly. These and other additions, deletions, and modifications might well be made by skilled artisans without departing from the spirit and scope of the invention as set forth in the claims.

What is claimed is:

1. A threshold assembly for installation in a handicapped accessible entryway having spaced vertical jambs extending upwardly from an entryway floor, said threshold assembly being sized to be positioned on the floor of the entryway extending between the vertical jambs and being profiled for allowing wheelchair ingress and egress through the entryway, said threshold assembly comprising an elongated body having opposed ends, said elongated body being integrally formed to define an upwardly projecting and longitudinally extending threshold portion with an upper surface aligned with and underlying a closed door of the entryway, an exterior sill extending outwardly and sloping downwardly from said threshold portion to an exterior edge of said body, and an interior sill extending inwardly and sloping downwardly from said threshold portion to an interior edge of said body, said threshold portion projecting upwardly a predetermined distance from said interior and said exterior sills to form a first dam extending along the junction of said threshold portion and said exterior sill and a second dam extending along the junction of said threshold portion and said interior sill, said first and second dams forming a barrier against migration of water from said sills past said threshold portion of said body.

2. A threshold assembly as claimed in claim 1 and wherein said elongated body is formed of extruded aluminum.

3. A threshold assembly as claimed in claim 2 and further comprising a thermal break formed along the length of said body, said thermal break being bridged by a thermally insulating material.

4. A threshold assembly as claimed in claim 1 and further comprising a sidelight cap mountable on said body covering a selected section of said threshold portion, said sidelight cap being configured to be selectively positioned on said body to underlie and support a fixed panel of the entryway.

5. A threshold assembly as claimed in claim 4 and further comprising an outwardly projecting lip extending along the upper edge of said first dam and an inwardly projecting lip formed along the upper edge of said second dam, said lips and said dams defining elongated grooves extending along the junctions of said dams and their respective sills, said sidelight cap being formed with tabs configured to snap into said grooves to secure said sidelight cap to said body and to allow said sidelight cap to be selectively positionable along the length of said body to accommodate a variety of entryway configurations.

6. A threshold assembly as claimed in claim 5 and wherein said sidelight cap is formed of extruded plastic material.

7. A threshold assembly as claimed in claim 6 and further comprising a flexible seal co-extruded along the upper surface of said sidelight cap for sealing against the bottom of a sidelight panel supported by said sidelight cap.

8. A threshold assembly as claimed in claim 7 and further comprising flexible seals co-extruded with said sidelight cap and positioned to seal against said exterior and said interior sills.

9. A continuous threshold assembly for installation in wheelchair accessible entryways having at least one openable door and at least one fixed panel flanking the openable door, said threshold assembly comprising a unitarily formed elongated body sized to span the entryway and having a profile allowing the threshold assembly to be traversed by an individual in a wheelchair, said elongated body being formed to define an upwardly projecting threshold portion positioned to extend continuously beneath a closed door of the entryway and a fixed panel of the entryway, an exterior sill extending outwardly and sloping downwardly from said threshold portion to an exterior edge, an interior sill extending inwardly and sloping downwardly from said threshold portion to an interior edge, and a sidelight cap selectively positionable along the length of said elongated body to overlie a section of said threshold portion, said sidelight cap for positioning beneath and supporting a fixed panel of the entryway;

said threshold portion of said elongated body projecting upwardly a predetermined distance from said exterior sill to define a first dam extending along the junction of said exterior sill and said threshold portion; and wherein said threshold portion of said elongated body also projects upwardly a predetermined distance from said interior sill to define a second dam extending along the junction of said interior sill and said threshold portion.

10. A continuous threshold assembly as claimed in claim 9 and further comprising a first lip extending along the upper edge of said first dam and a second lip extending along the upper edge of said second dam, said lips and said dams defining an exterior groove and an interior groove extending along the length of said elongated body on either side of said threshold portion.

11. A continuous threshold assembly as claimed in claim 10 and wherein said sidelight cap is formed with an upper surface having an exterior edge and an interior edge, exterior and interior legs depending from said exterior and interior edges respectively of said support surface for resting on said exterior and interior sills to position said support surface over said threshold portion, and tabs projecting inwardly from said exterior and interior legs for extending into said exterior and said interior grooves to secure said sidelight cap in place at a selected location along said body for underlying and supporting a fixed panel.

12. A continuous threshold assembly as claimed in claim 11 and wherein said elongated body is formed of extruded aluminum.

13. A continuous threshold assembly as claimed in claim 12 and wherein said sidelight cap is formed of extruded plastic material.

14. A continuous threshold assembly as claimed in claim 13 further comprising a flexible seal on said support surface of said sidelight cap for engaging and sealing against the bottom of a fixed panel supported on said sidelight cap.

15. A continuous threshold assembly as claimed in claim 14 and wherein said flexible seal is co-extruded with said sidelight cap of a plastic material having a lower durometer than the plastic material of said sidelight cap.

16. A continuous threshold assembly as claimed in claim 15 and further comprising flexible seals coextruded on said exterior and interior legs for engaging and sealing against said exterior and interior sills respectively when said sidelight panel is mounted on said body.

* * * * *